US006131620A

United States Patent [19]

Mette

[11] Patent Number: 6,131,620

[45] Date of Patent: Oct. 17, 2000

[54] BADGE PIN STRAIGHTENING AND ALIGNING TOOL

[76] Inventor: Kenneth R. Mette, 4696 Territorial LP, Sierra Vista, Ariz. 85635

[21] Appl. No.: 09/244,411

[22] Filed: Feb. 4, 1999

[51] Int. Cl.[7] ..... B21F 1/02

[52] U.S. Cl. ..... 140/147; 33/653; 140/123

[58] Field of Search ..... 33/567, 653, 662; 7/164; 72/457, 458; 140/106, 123, 147; 254/18, 22

[56] References Cited

U.S. PATENT DOCUMENTS

| | | | |
|---|---|---|---|
| 2,800,818 | 7/1957 | Larson | 72/458 |
| 2,853,791 | 9/1958 | Wood | 33/653 |
| 3,129,515 | 4/1964 | Best | 33/653 |
| 4,584,774 | 4/1986 | Link | 33/567 |
| 5,471,759 | 12/1995 | Burrows et al. | 33/567 |

*Primary Examiner*—Lowell A. Larson

[57] ABSTRACT

A badge pin straightening and aligning tool for straightening and aligning bent pins on badges, service ribbons and decorations. The badge pin straightening and aligning tool includes a plate with first and second faces, a spaced apart pair of end edges, and a spaced apart pair of side edges extending between the end edges of the plate. The plate has a cutout adjacent a first of the end edges of the plate and a first of the side edges of the plate to form an extent portion of the plate adjacent the first end edge of the plate and a second of the side edges of the plate. The plate has a bore extending therethrough between the first and second faces of the plate located towards a second of the end edges of the plate.

7 Claims, 2 Drawing Sheets

BADGE PIN STRAIGHTENING AND ALIGNING TOOL

BACKGROUND OF THE INVENTION

1. Field of the Invention

The present invention relates to badge pin straightening and aligning tools and more particularly pertains to a new badge pin straightening and aligning tool for straightening and aligning bent pins on badges, service ribbons and decorations.

2. Description of the Prior Art

The use of badge pin straightening and aligning tools is known in the prior art. More specifically, badge pin straightening and aligning tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,537,098 by Keck; U.S. Pat. No. 3,795,036 by Roebuck; U.S. Pat. No. Des. 271,372 by Fortune; U.S. Pat. No. 4,034,595 by Smith; U.S. Pat. No. 5,389,099 by Hartmeister et al.; and U.S. Pat. No. 2,719,358 by Lassen.

While these devices fulfill their respective, particular objectives and requirements, the aforementioned patents do not disclose a new badge pin straightening and aligning tool. The inventive device includes a plate with first and second faces, a spaced apart pair of end edges, and a spaced apart pair of side edges extending between the end edges of the plate. The plate has a cutout adjacent a first of the end edges of the plate and a first of the side edges of the plate to form an extent portion of the plate adjacent the first end edge of the plate and a second of the side edges of the plate. The plate has a bore extending therethrough between the first and second faces of the plate located towards a second of the end edges of the plate.

In these respects, the badge pin straightening and aligning tool according to the present invention substantially departs from the conventional concepts and designs of the prior art, and in so doing provides an apparatus primarily developed for the purpose of straightening and aligning bent pins on badges, service ribbons and decorations.

SUMMARY OF THE INVENTION

In view of the foregoing disadvantages inherent in the known types of badge pin straightening and aligning tools now present in the prior art, the present invention provides a new badge pin straightening and aligning tool construction wherein the same can be utilized for straightening and aligning bent pins on badges, service ribbons and decorations.

The general purpose of the present invention, which will be described subsequently in greater detail, is to provide a new badge pin straightening and aligning tool apparatus and method which has many of the advantages of the badge pin straightening and aligning tools mentioned heretofore and many novel features that result in a new badge pin straightening and aligning tool which is not anticipated, rendered obvious, suggested, or even implied by any of the prior art badge pin straightening and aligning tools, either alone or in any combination thereof.

To attain this, the present invention generally comprises a plate with first and second faces, a spaced apart pair of end edges, and a spaced apart pair of side edges extending between the end edges of the plate. The plate has a cutout adjacent a first of the end edges of the plate and a first of the side edges of the plate to form an extent portion of the plate adjacent the first end edge of the plate and a second of the side edges of the plate. The plate has a bore extending therethrough between the first and second faces of the plate located towards a second of the end edges of the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new badge pin straightening and aligning tool apparatus and method which has many of the advantages of the badge pin straightening and aligning tools mentioned heretofore and many novel features that result in a new badge pin straightening and aligning tool which is not anticipated, rendered obvious, suggested, or even implied by any of the prior art badge pin straightening and aligning tools, either alone or in any combination thereof.

It is another object of the present invention to provide a new badge pin straightening and aligning tool which may be easily and efficiently manufactured and marketed.

It is a further object of the present invention to provide a new badge pin straightening and aligning tool which is of a durable and reliable construction.

An even further object of the present invention is to provide a new badge pin straightening and aligning tool which is susceptible of a low cost of manufacture with regard to both materials and labor, and which accordingly is then susceptible of low prices of sale to the consuming public, thereby making such badge pin straightening and aligning tool economically available to the buying public.

Still yet another object of the present invention is to provide a new badge pin straightening and aligning tool which provides in the apparatuses and methods of the prior art some of the advantages thereof, while simultaneously overcoming some of the disadvantages normally associated therewith.

Still another object of the present invention is to provide a new badge pin straightening and aligning tool for straightening and aligning bent pins on badges, service ribbons and decorations.

Yet another object of the present invention is to provide a new badge pin straightening and aligning tool which includes a plate with first and second faces, a spaced apart pair of end edges, and a spaced apart pair of side edges extending between the end edges of the plate. The plate has a cutout adjacent a first of the end edges of the plate and a first of the side edges of the plate to form an extent portion of the plate adjacent the first end edge of the plate and a second of the side edges of the plate. The plate has a bore extending therethrough between the first and second faces of the plate located towards a second of the end edges of the plate.

Still yet another object of the present invention is to provide a new badge pin straightening and aligning tool that straightens bent pins without breaking them.

Even still another object of the present invention is to provide a new badge pin straightening and aligning tool that is small enough so that it may be unobtrusively carried on a military identification tag chain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
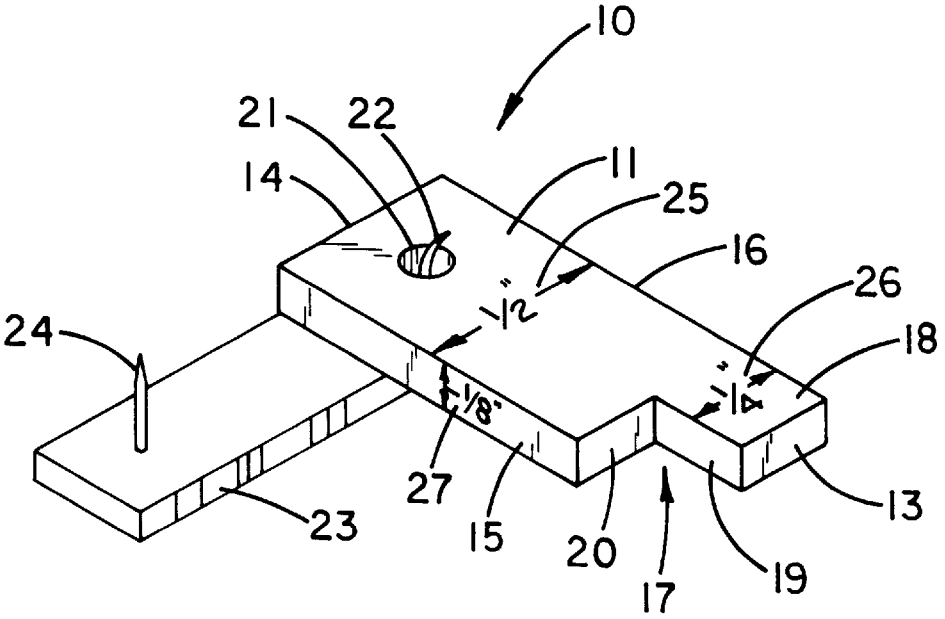
FIG. 1 is a schematic perspective view of a new badge pin straightening and aligning tool in use straightening an attachment pin of a badge according to the present invention.

With reference now to the drawings, and in particular to FIGS. 1 through 4 thereof, a new badge pin straightening and aligning tool embodying the principles and concepts of the present invention will be described.

As best illustrated in FIGS. 1 through 4, the badge pin straightening and aligning tool generally comprises a plate with first and second faces, a spaced apart pair of end edges, and a spaced apart pair of side edges extending between the end edges of the plate. The plate has a cutout adjacent a first of the end edges of the plate and a first of the side edges of the plate to form an extent portion of the plate adjacent the first end edge of the plate and a second of the side edges of the plate. The plate has a bore extending therethrough between the first and second faces of the plate located towards a second of the end edges of the plate.

In closer detail, the tool comprises a generally rectangular plate 10 having substantially planar and substantially parallel first and second faces 11,12, a spaced apart pair of substantially straight and substantially parallel end edges 13,14, and a spaced apart pair of substantially straight and substantially parallel side edges 15,16 extending between the end edges of the plate. The side edges of the plate are extended substantially perpendicular to the end edges of the plate. The end and side edges of the plate each lie in planes extending substantially perpendicular to the first and second faces of the plate. The plate has a thickness defined between the first and second faces of the plate, a length defined between the end edges of the plate and a width defined between the side edges of the plate. In an ideal illustrative embodiment, the thickness of the plate is about ⅛ inch, the length of the plate is about 1 inch, and the width of the plate is about ½ inch.

The plate has a generally L-shaped cutout 17 adjacent a first of the end edges of the plate and a first of the side edges of the plate to form a generally rectangular extent portion 18 of the plate adjacent the first end edge of the plate and a second of the side edges of the plate. The cutout has periphery comprising a substantially straight end portion 19 and a substantially straight side portion 20 extending substantially perpendicular to the end portion of the cutout. Preferably, the end portion of the cutout is extended substantially perpendicularly from the first end edge of the plate towards a second of the end edges of the plate substantially parallel to the side edges of the plate. Also preferably, the end portion of the cutout is positioned at a midpoint of the first end edge of the plate substantially equidistant to each of the side edges of the plate. The side portion of the cutout is extended substantially perpendicularly from the first side edge of the plate towards the second side edge of the plate substantially parallel to the end edges of the plate.

The end and side portions each have a length substantially equal to one another. The length of the end portion is defined in a direction substantially parallel to the side edges of the plate. The length of the side portion is defined in a direction substantially parallel to the end edges of the plate. The lengths of the end and side portions of the cutout each are preferably substantially equal to about one-half of the width of the plate. Ideally, the length and width of the end and side portions of the cutout are each about ¼ inch.

The extent portion of the plate has a length defined in a direction substantially parallel to the side edges of the plate and a width defined substantially parallel to the end edges of the plate. Preferably, the length and width of the extent portion are substantially equal to one another with the length and width of the extent portion each being substantially equal to about one-half the width of the plate. Ideally, the length and width of the extent portion are each about ¼ inch.

The plate has a generally cylindrical bore 21 extending therethrough between the first and second faces of the plate. The bore is positioned towards the second end edge of the plate ideally about ⅛ inch from the second end edge. The bore has a center axis extending substantially perpendicular to the planes in which the first and second faces of the plate lie. Preferably, the center axis of the bore is substantially equidistantly positioned between the side edges of the plate.

In use, the tool is designed for straightening out bent attachment pins 22 outwardly extending from the back faces of badges 23, service ribbons and decorations that are desired for fastening to a garment. Straight attachment pins 24 typically have a tip and a longitudinal axis extending between the badge and the tip of the attachment pin. As best illustrated in FIG. 1, when bent, the attachment pins have a bend between the defining a bent portion between the bend and the tip extending obliquely to the longitudinal axis of the attachment pin. The bent attachment pin is extended through the bore of the plate such that the bend is positioned in the bore between the faces of the plate. The plate may then be twisted and moved in relation to the badge such that a portion of the attachment pin engages a portion of a periphery of the bore of the plate and further twisting of the plate bends the attachment pin to straighten the bend so that the bent portion of the attachment pin is collinear with the longitudinal axis of the attachment pin.

Figure 2:
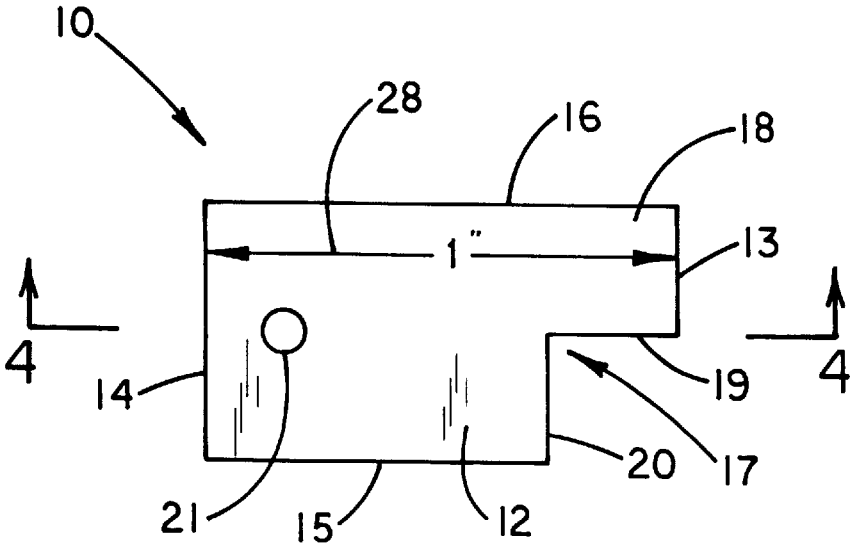
FIG. 2 is a schematic plan view of the present invention.
Figure 3:
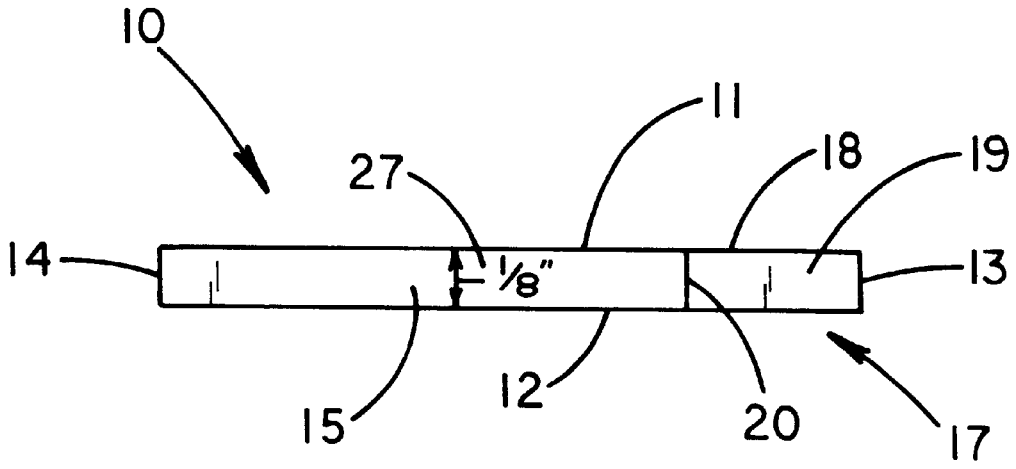
FIG. 3 is a schematic side view of the present invention.
Figure 4:
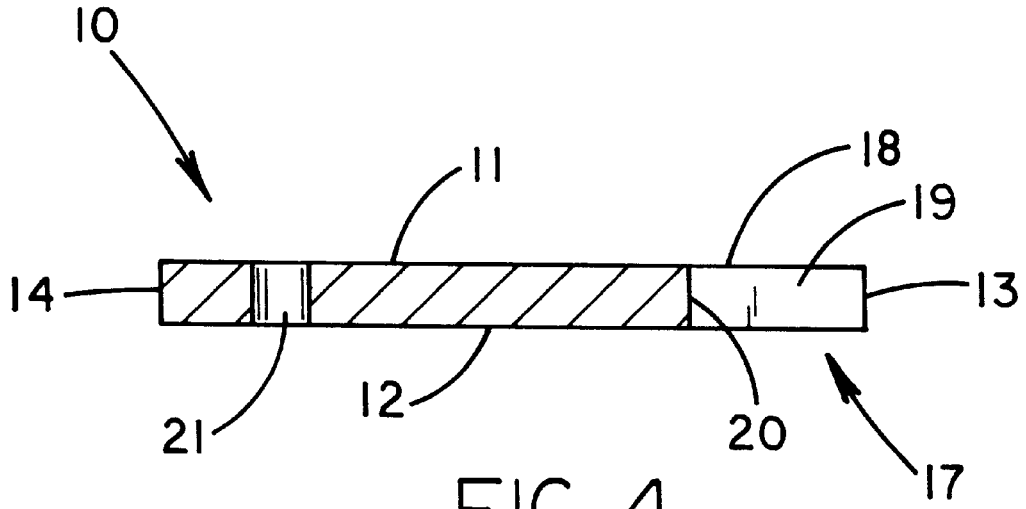
FIG. 4 is a schematic cross sectional view of the present invention taken from line 4—4 of FIG. 2.

The tool may also be used to properly align and space badges, service ribbons and decorations on a garment.. The right-angled relationships of the end edges, side edges, end and side portions of the plate are ideal for helping to insure that badges are properly lined up on a garment. In preferred embodiment, the first and second faces each have measuring indicia thereon (ideally, either stamped or engraved therein) so that a user may use the plate to accurately measure distances and spacing between badges, service ribbons and decorations attached to a garment. In an ideal version of this embodiment, measuring indicia includes indicia 25 on the first face of the plate indicating ½ inch between the side edge of the plate and indicia 26 indicating ¼ inch between sides of the extent portion as illustrated in FIG. 1. Further included indicia in this idea version includes the indicia 27 on the first side edge of the plate indicating ⅛ inch between the faces of the plate and, as illustrated in FIG. 2, indicia 28 extending between the end edges of the plate indicating 1 inch on the second face of the plate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for straightening and aligning attachment pins outwardly extending from a back face of a badge, said tool comprising:

a plate having first and second faces, a spaced apart pair of end edges, and a spaced apart pair of side edges extending between said end edges of said plate;

said plate having a cutout adjacent a first of said end edges of said plate and a first of said side edges of said plate to form an extent portion of said plate adjacent said first end edge of said plate and a second of said side edges of said plate;

said cutout having periphery comprising an end portion and a side portion;

said plate having a bore extending therethrough between said first and second faces of said plate;

said bore being positioned towards a second of said end edges of said plate; and wherein said plate has a length and a width such that said width of said plate is about half said length of said plate, said extent of said plate having a width such that said width of said extent is about half said width of said plate, said plate having thickness such that said thickness of said plate is about half of said width of said extent such that said plate can be concealed in a uniform pocket by a user.

2. The tool of claim 1, wherein said first and second faces of said plate are substantially planar and substantially parallel to one another.

3. The tool of claim 1, wherein said end edges are substantially straight and substantially parallel to one another, wherein said side edges are substantially straight and substantially parallel to one another and extend substantially perpendicular to said end edges of said plate.

4. The tool of claim 1, wherein said side portion of said cutout extends substantially perpendicular to said end portion of said cutout, said end portion of said cutout being extended substantially perpendicularly from said first end edge of said plate, and said end side portion of said cutout being extended substantially perpendicularly from said first side edge of said plate.

5. The tool of claim 4, wherein said end portion of said cutout is positioned at a midpoint of said first end edge of said plate substantially equidistant to each of said side edges of said plate.

6. The tool of claim 4, wherein said end and side portions each having a length substantially equal to one another.

7. In combination:

a generally rectangular plate having substantially planar and substantially parallel first and second faces, a spaced apart pair of substantially straight and substantially parallel end edges, and a spaced apart pair of substantially straight and substantially parallel side edges extending between said end edges of said plate;

said side edges of said plate being extended substantially perpendicular to said end edges of said plate;

said end and side edges of said plate each lying in plane extending substantially perpendicular to said first and second faces of said plate;

said plate having a thickness defined between said first and second faces of said plate, a length defined between said end edges of said plate and a width defined between said side edges of said plate;

wherein said thickness of said plate is about ⅛ inch, said length of said plate is about 1 inch, and said width of said plate is about ½ inch such that said plate can be concealed in a uniform pocket by a user;

said plate having a generally L-shaped cutout adjacent a first of said end edges of said plate and a first of said side edges of said plate to form a generally rectangular extent portion of said plate adjacent said first end edge of said plate and a second of said side edges of said plate;

said cutout having periphery comprising a substantially straight end portion and a substantially straight side portion extending substantially perpendicular to said end portion of said cutout;

said end portion of said cutout being extended substantially perpendicularly from said first end edge of said plate towards a second of said end edges of said plate substantially parallel to said side edges of said plate;

said end portion of said cutout being positioned at a midpoint of said first end edge of said plate substantially equidistant to each of said side edges of said plate;

said end side portion of said cutout being extended substantially perpendicularly from said first side edge of said plate towards said second side edge of said plate substantially parallel to said end edges of said plate;

said end and side portions each having a length substantially equal to one another, said length of said end portion being defined in a direction substantially parallel to said side edges of said plate, said length of said side portion being defined in a direction substantially parallel to said end edges of said plate;

said lengths of said end and side portions of said cutout each being substantially equal to about one-half of said width of said plate;

wherein said length and width of said end and side portions of said cutout are each about ¼ inch;

said extent portion of said plate having a length defined in a direction substantially parallel to said side edges of said plate and a width defined substantially parallel to said end edges of said plate;

said length and width of said extent portion being substantially equal to one another, said length and width of said extent portion each being substantially equal to about one-half said width of said plate;

wherein said length and width of said extent portion are each about ¼ inch;

said plate having a generally cylindrical bore extending therethrough between said first and second faces of said plate;

said bore being positioned towards said second end edge of said plate, said bore having a center axis extending substantially perpendicular to the planes in which said first and second faces of said plate lie;

said center axis of said bore being substantially equidistantly positioned between said side edges of said plate;

a badge having a back face and an attachment pin outwardly extending from said back face of said badge;

said attachment pin having a tip and a longitudinal axis extending between said badge and said tip of said attachment pin;

said pin having a bend defining a bent portion between said bend and said tip extending obliquely to said longitudinal axis of said attachment pin; and said attachment pin being extended through said bore of said plate such that said bend is positioned in said bore between said faces of said plate.

* * * * *